United States Patent [19]

Vreeswijk et al.

[11] 3,955,866

[45] May 11, 1976

[54] METHOD OF MANUFACTURING A FLASH LAMP

[75] Inventors: Johannes Cornelis Antonie Vreeswijk; Henricus Petrus Wilhelmus Wolffensperger, both of Terneuzen, Netherlands

[73] Assignee: U.S. Philips Corporation, New York, N.Y.

[22] Filed: Aug. 9, 1974

[21] Appl. No.: 496,180

[30] Foreign Application Priority Data

Aug. 28, 1973 Netherlands ..... 7311779

[52] U.S. Cl. ..... 316/20

[51] Int. Cl.[2] ..... H01J 9/385

[58] Field of Search..... 29/25.11, 25.1, 25.18, 29/25.19; 316/20.19, 18, 17, 1; 72/342; 148/11.5 R, 11.5 F

[56] References Cited

UNITED STATES PATENTS

| | | | |
|---|---|---|---|
| 3,188,162 | 6/1965 | Anderson et al. | 316/20 |
| 3,336,646 | 8/1967 | Chauvin | 29/25.11 |
| 3,434,818 | 3/1969 | Chauvin | 65/270 |
| 3,739,441 | 6/1973 | Kaufmann et al. | 29/25.13 |

*Primary Examiner*—Roy Lake
*Assistant Examiner*—James W. Davie
*Attorney, Agent, or Firm*—Frank R. Trifari

[57] ABSTRACT

The invention relates to a method of manufacturing a flash lamp comprising an envelope which is filled with thin strips of combustible material, in which a ball of the strip material is compressed to the desired shape in a tube by means of two dies and is annealed in that shape in a stress-free manner.

9 Claims, 6 Drawing Figures

METHOD OF MANUFACTURING A FLASH LAMP

The invention relates to a method of manufacturing a flashlight lamp comprising an envelope which is filled with thin strips of combustible material, in which a ball consisting of a number of such strips is subjected to a forming treatment in a tube the ball is then positioned in the envelope. Such a method is known from U.S. Pat. No. 3,336,646.

In the technology of combustion flash lamps it is known that the distribution in the envelope of the combustible material, (which may consist of strips of, for example, aluminium, magnesium or zirconium,) in the envelope of a combustion influences the luminous efficiency thereof. It is generally endeavoured to obtain a distribution of the strips in the envelope which is as uniform as possible. In manufacturing a series of combustion flash lamps, it is desirable that each lamp in the series yield the minimum required quantity of light. One way to accomplish this is to provide more combustible material than would be required if there was a uniform distribution of the strips. This construction is undesirable because it increases the material cost for the product.

It is the object of the invention to provide a method of manufacturing a flash lamp in which a very uniform distribution of the combustible material in the envelope is achieved.

In the above-mentioned known method a number of strips destined for one flash lamp are provided in a cylindrical space. In that space the strip material is given a rotating movement by means of directed jets of air so that a fluffy ball having a mainly spherical shape is obtained. This ball is then positioned in the lamp envelope.

Since the ball, due to the rotating movement in the cylindrical space, assumes a mainly spherical shape, this method is particularly suitable for manufacturing flash lamps having a likewise mainly spherical envelope. In the manufacture of flash lamps having an elongate envelope, (needle lamps,) the known method has proved to be less suitable to produce a uniform distribution of the strips in the envelope. A further drawback of known method is that after providing the ball in the envelope a part of one or more strips may land, as a result of resilient action, in the part of the envelope which is sealed in a later stage. This is a result of the fact that the strips which may be slightly deformed during the formation of the spherical ball relax after introducing the ball in the envelope. This may result in a poor sealing.

It is the object of the invention to provide a method which does not exhibit said drawbacks.

For that purpose, the above-described method according to the invention is characterized in that the ball is compressed to the desired shape in the tube by means of opposed dies and is then annealed in that shape in a stress-free manner. The diameter of the tube and the smallest distance between the dies during the compression operation normally will be substantially equal to the dimensions of the envelope for which the ball is destined. Furthermore, the method according to the invention presents the possibility of forming a ball which includes a cavity on a side thereof facing the cap of the flash lamp. Such a ball may be formed by using a die which has a projection extending in the direction of the oppositely located die. The stress-free annealing ensures that the strips will not change contour after positioning the ball into the envelope so that the danger of poorly sealed lamps is decreased. When the method according to the invention is used in series production the quantity of combustible material may be reduced without prejudicing the minimum light output standards, this yields a saving of the required quantity of combustible material.

Surprisingly, the stress-free annealing yields another result. It has actually been found that the stress-free annealing increases the time which expires between the instant at which the first strip ignites and the instant at which the light intensity is maximum ($T_{max}$). This phenomenon is probably caused by the change of the surface state of the strips as a result of the annealing. The extra advantage of the stress-free annealing resides in the fact that a possibility is presented of influencing the $T_{max}$ of the flashlight lamp purposefully.

It has furthermore been found that a good non-deformability of the ball and a good possibility of influencing the $T_{max}$ are obtained, when, according to a favourable embodiment of the method according to the invention the stress-free annealing is carried out in an inert atmosphere, for example, a nitrogen or argon atmosphere, at a temperature of at least 400°C.

Said favourable results can also be achieved when the stress-free annealing is carried out in a vacuum at a temperature of at least 250°C.

The stress-free annealing may be carried out by means of concentrated light beams. Said concentrated light beams can be obtained by a halogen lamp which is arranged in the focus of an elliptic reflector.

In another favourable embodiment of the method according to the invention the stress-free annealing is carried out by means of a high frequency electromagnetic field.

The invention furthermore relates to a flashlight lamp manufactured according to any of the above described methods.

The method according to the invention will now be described in greater detail with reference to the drawing, in which.

Figures 1A, 1B, 1C, 1D:
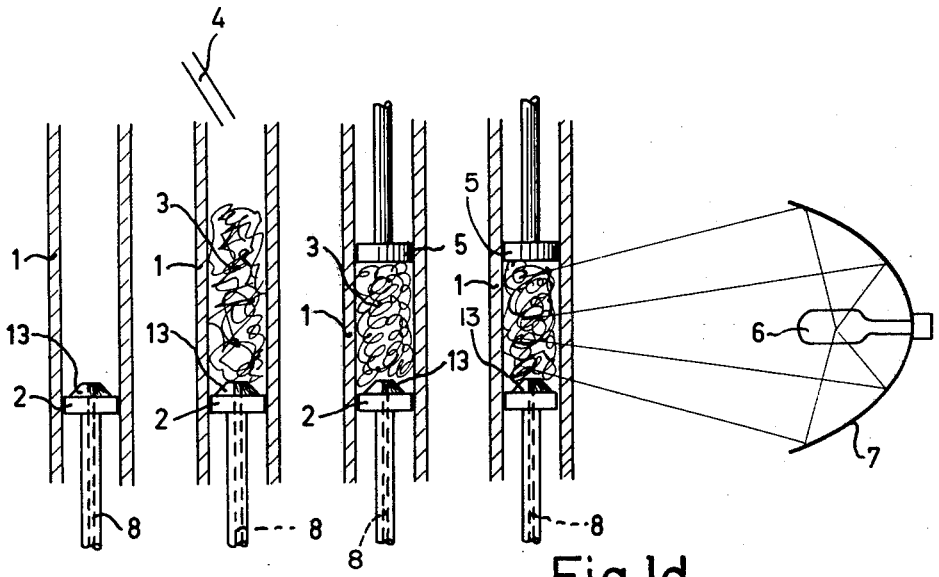
FIG. 1 shows the successive stages of manufacture.

FIG. 1*a* shows a tube 1 and a first die 2. Approximately 35 thin strips of zirconium 3 are provided in said tube via a supply line denoted by 4 (see FIG. 1*b*). The strips used in this embodiment have a length of 100 mm, a width of 40 $\mu$ and a height of 20 $\mu$. In the next step (see FIG. 1*c*) the strip material is compressed to the desired shape by means of a second die 5. The smallest distance between the dies 2 and 5 during said compression operation, and of course the inner diameter of the tube, are chosen in agreement with the dimensions of the envelope of the flash lamp for which the ball 3 is destined. It is furthermore obvious that the density of the ball can be influenced by varying the quantity of material provided in the tube. After the ball has assumed the desired shape as a result of the operation of the dies, the strip material is annealed so as to be stress-free (see FIG. 1*d*) by means of a number of concentrated light beams of which only one is shown in FIG. 1*d*. Said concentrated light beams are obtained by means of halogen lamps 5 which are arranged in the focus of elliptic reflectors 7. The stress-free annealing in this embodiment is carried out at a temperature of 450°C and lasts 5 seconds. During annealing, an inert gas, in this case nitrogen, is supplied to the ball via a duct 8 in the die 2. As a result of the supply of the inert gas it is prevented that oxidation of the zirconium occurs during annealing. Said oxidation may also suitably be prevented by annealing in a vacuum.

Figure 2:
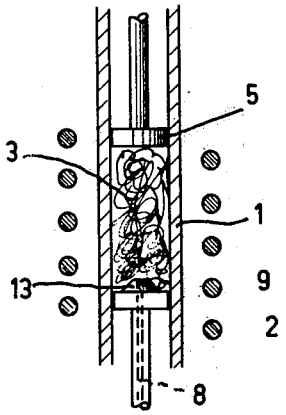
FIG. 2 shows the use of an electromagnetic field.

According to the embodiment shown in FIG. 2 the stress-free annealing is carried out by means of a high frequency electromagnetic field which is produced by a coil 9 surrounding the tube 1.

After the stress-free annealing the ball is inserted into the envelope 10 of a flashlight lamp, which envelope is then sealed.

Figure 3:
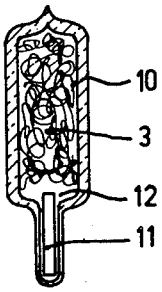
FIG. 3 shows a flashlight lamp manufactured according to the method of the invention.

FIG. 3 shows such a flashlight lamp which in this case is constructed as a so-called percussion flash lamp.

As was already explained above, a ball of any desired shape can be obtained by means of the method according to the invention. In this embodiment a ball is manufactured which has a small cavity 12 on its side facing the cap 11 of the flashlight lamp. Said cavity 12 is formed by a projection 13 which is present on the die 2 and points in the direction of the oppositely located die 5.

What is claimed is:

1. A method of manufacturing a flash lamp having an envelope filled with thin strips of intertwined combustible material which comprises: providing a chamber and a reciprocally mounted first die having a peripheral face dimensioned and configured for snug fitting engagement within said chamber during reciprocation of said first die; introducing a quantity of intertwined elongated pieces of combustible material into said chamber; compressing said quantity of material to the shape of said chamber by reciprocation of said first die; annealing the shaped material to a stress-free state; inserting said shaped material into said envelope; and sealing said envelope.

2. A method as claimed in claim 1, wherein said annealing step is carried out in an inert atmosphere at a temperature of at least 400°C.

3. A method as claimed in claim 1, wherein said annealing step is carried out in a vacuum at a temperature of at least 250°C.

4. A method as claimed in claim 1, wherein said annealing step is carried out by means of concentrated light beams.

5. A method as claimed in claim 1 wherein said annealing step is carried out by means of a high frequency electromagnetic field.

6. The method as described in claim 1 wherein said chamber is cylindrical and said first providing step includes providing a second die mounted for reciprocation, said second die being disposed in opposed relation to said first die, and dimensioned and configured for snug fitting engagement with said chamber; and said compressing step includes reciprocation of said first and second dies.

7. The method as described in claim 6 wherein said chamber is tubular and said first and second dies are cylindrical and said chamber and dies being coaxial.

8. The method as described in claim 2 wherein said inert atmosphere is nitrogen.

9. The method as described in claim 2 wherein said inert atmosphere is argon.

* * * * *